US008064756B2

(12) United States Patent
Liu

(10) Patent No.: US 8,064,756 B2
(45) Date of Patent: Nov. 22, 2011

(54) AIRFLOW DIRECTING STRUCTURE FOR HAND DRYERS

(75) Inventor: Shen-Chen Liu, Rueifang Township, Taipei County (TW)

(73) Assignee: Hokwang Industries Co., Ltd., Rueifang Township, Taipei County (TW)

( * ) Notice: Subject to any disclaimer, the term of this patent is extended or adjusted under 35 U.S.C. 154(b) by 395 days.

(21) Appl. No.: 12/468,873

(22) Filed: May 20, 2009

(65) Prior Publication Data

US 2010/0296799 A1 Nov. 25, 2010

(51) Int. Cl.
*A47J 27/00* (2006.01)
*F24H 3/02* (2006.01)

(52) U.S. Cl. ..... 392/380; 392/360; 392/379

(58) Field of Classification Search ..... None
See application file for complete search history.

(56) References Cited

U.S. PATENT DOCUMENTS

| | | | | | |
|---|---|---|---|---|---|
| 2,651,705 | A * | 9/1953 | Clemens | 392/381 |
| 2,853,591 | A * | 9/1958 | Fine | 392/381 |
| 3,377,715 | A * | 4/1968 | Hubner | 34/99 |
| 3,702,918 | A * | 11/1972 | Moller | 392/369 |
| 3,807,495 | A * | 4/1974 | Skarecky | 165/122 |
| 4,383,377 | A * | 5/1983 | Crafton | 34/60 |
| 4,785,162 | A * | 11/1988 | Kuo | 392/381 |
| 4,999,929 | A * | 3/1991 | Dutton | 34/90 |
| 5,181,328 | A * | 1/1993 | Bouverie | 34/97 |
| 5,243,682 | A * | 9/1993 | Eberts | 392/370 |
| 5,404,419 | A * | 4/1995 | Artis, Jr. | 392/381 |
| 5,555,647 | A * | 9/1996 | Torborg et al. | 34/601 |
| 6,602,058 | B1 * | 8/2003 | Stewart | 417/366 |
| D481,116 | S * | 10/2003 | Wang et al. | D23/383 |
| 6,766,589 | B1 * | 7/2004 | Bory et al. | 34/90 |
| 7,039,301 | B1 | 5/2006 | Aisenberg et al. | |
| D610,746 | S * | 2/2010 | Hsu | D28/54.1 |
| 7,946,055 | B2 * | 5/2011 | Churchill et al. | 34/80 |
| 2002/0025144 | A1 * | 2/2002 | Baribeault et al. | 392/371 |

FOREIGN PATENT DOCUMENTS

| | | |
|---|---|---|
| TW | 254101 | 8/1995 |
| TW | I266629 | 11/2006 |

* cited by examiner

*Primary Examiner* — Thor Campbell
(74) *Attorney, Agent, or Firm* — Muncy, Geissler, Olds & Lowe, PLLC

(57) ABSTRACT

An airflow directing structure for hand dryers includes an airflow directing case, an air inlet, an air outlet, a heating means, an air intake means and a flow directing channel. The air intake means has a rotary axle which has one end fastened to air intake blades. The flow directing channel has an air intake passage communicating with the air inlet, a tortuous passage communicating with the air intake passage and an air exit passage with one end communicating with the tortuous passage and the other end communicating with the air outlet. The air exit passage and the air intake means are parallel in a juxtaposed manner, and located on the same side with the air intake blades and the air outlet. Thus total size of the airflow directing structure is smaller and the cost is lower, and an optimal heating speed can be achieved to improve drying efficiency.

14 Claims, 6 Drawing Sheets

AIRFLOW DIRECTING STRUCTURE FOR HAND DRYERS

FIELD OF THE INVENTION

The present invention relates to a drying apparatus and particularly to a hand dryer to dry moisture on user's hands.

BACKGROUND OF THE INVENTION

Hand dryers are commonly used in lavatories to aid users to dry hands after washing. The conventional hand dryer usually has a motor and a heating structure. The motor draws in air which is heated by the heating structure and generates a powerful heated airflow to dispel or dry residual moisture on user's hands.

However, compared with paper towel, the hand dryer takes more time and consumes electric energy when in use. Hence how to increase hand drying efficiency to reduce energy consumption is a big issue in the industry. To increase hand drying efficiency, one approach is to boost motor efficiency to generate a stronger airflow pressure to dispel the moisture from user's hands. Another approach is to enhance the efficiency of the heating structure and increase airflow exit temperature to dry the moisture on the hands easier. The stability of heated airflow passage in the hand dryer often is overlooked. Hence there still leaves a lot to be desired in terms of airflow exit efficiency.

A desired airflow passage in the hand dryer can produce a higher airflow exit efficiency to dispel or dry the moisture from user's hands at a shorter time. Use duration of the hand dryer not only affects user's convenience also impacts optimal energy utilization. If the air drawn by the motor can be transformed to effective exit airflow, energy waste can be greatly reduced.

The commonly used hand dryers, open through type or wall-mounted type, such as R.O.C. patent No. I266629 entitled "Hand drying apparatus", No. 254101 entitled "Multi-function dryer", or U.S. Pat. No. 7,039,301 do not focus on the size of the hand dryer. The hand dryers they proposed are quite bulky. Due to environment and space constraints, their applicability and installation are restricted. There is still a need to develop a compact hand dryer with a higher exit airflow efficiency to improve the problems mentioned above.

SUMMARY OF THE INVENTION

The primary object of the present invention is to reduce total size of airflow directing structure of hand dryers to lower material cost. Another object of the invention is to improve airflow to achieve optimal heating speed to enhance drying efficiency.

To achieve the foregoing objects, the invention provides an airflow directing structure for hand dryers. It includes an airflow directing case with a flow directing channel formed inside, an air inlet and an air outlet located in the airflow directing case communicating with the flow directing channel, a heating means located in the airflow directing case and an air intake means located in the airflow directing case. The air intake means has a rotary axle which has one end fastened to air intake blades. The invention provides features as follow: the flow directing channel has an air intake passage to hold the air intake means and communicate with the air inlet, a tortuous passage to hold the heating means and communicate with the air intake passage, and an air exit passage with one end communicating with the tortuous passage and the other end communicating with the air outlet. The air exit passage and the rotary axle are parallel in a juxtaposed manner, and located at the same side with the air intake blades and the air outlet.

Compared with the conventional techniques, the structure provided by the invention has the following advantages:

1. Due to the air exit passage is parallel with the rotary axle in a juxtaposed manner, the height of the airflow directing case can be reduced. Hence total size of the airflow directing structure of the hand dryer is smaller.

2. With the air exit passage in parallel with the rotary axle in a juxtaposed manner, and located on the same side with the air intake blades and the air outlet, the air inlet and air outlet are adjacent to each other. When the hand dryer is in operation, the air inlet can suck heated airflow discharged from the air outlet to get optimal heating efficiency.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
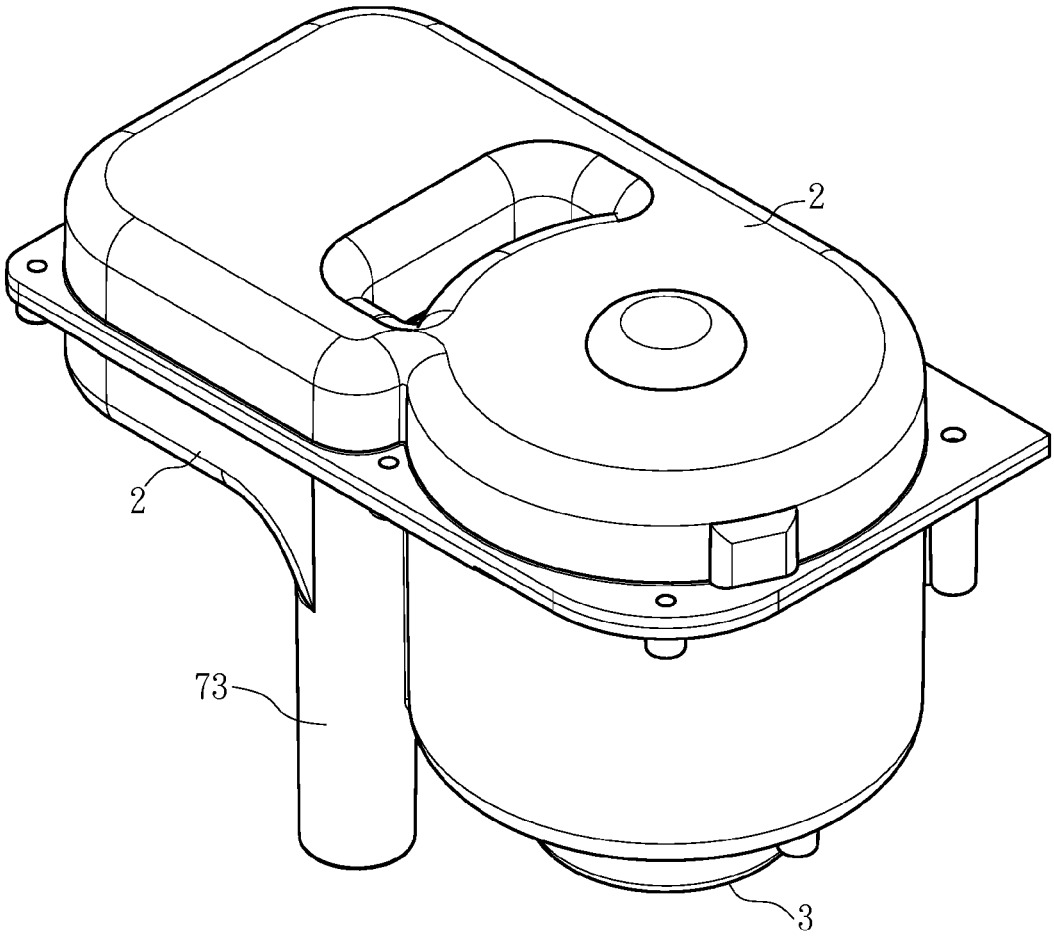
FIG. 1 is a perspective view of the airflow directing case of the invention.
Figure 2:
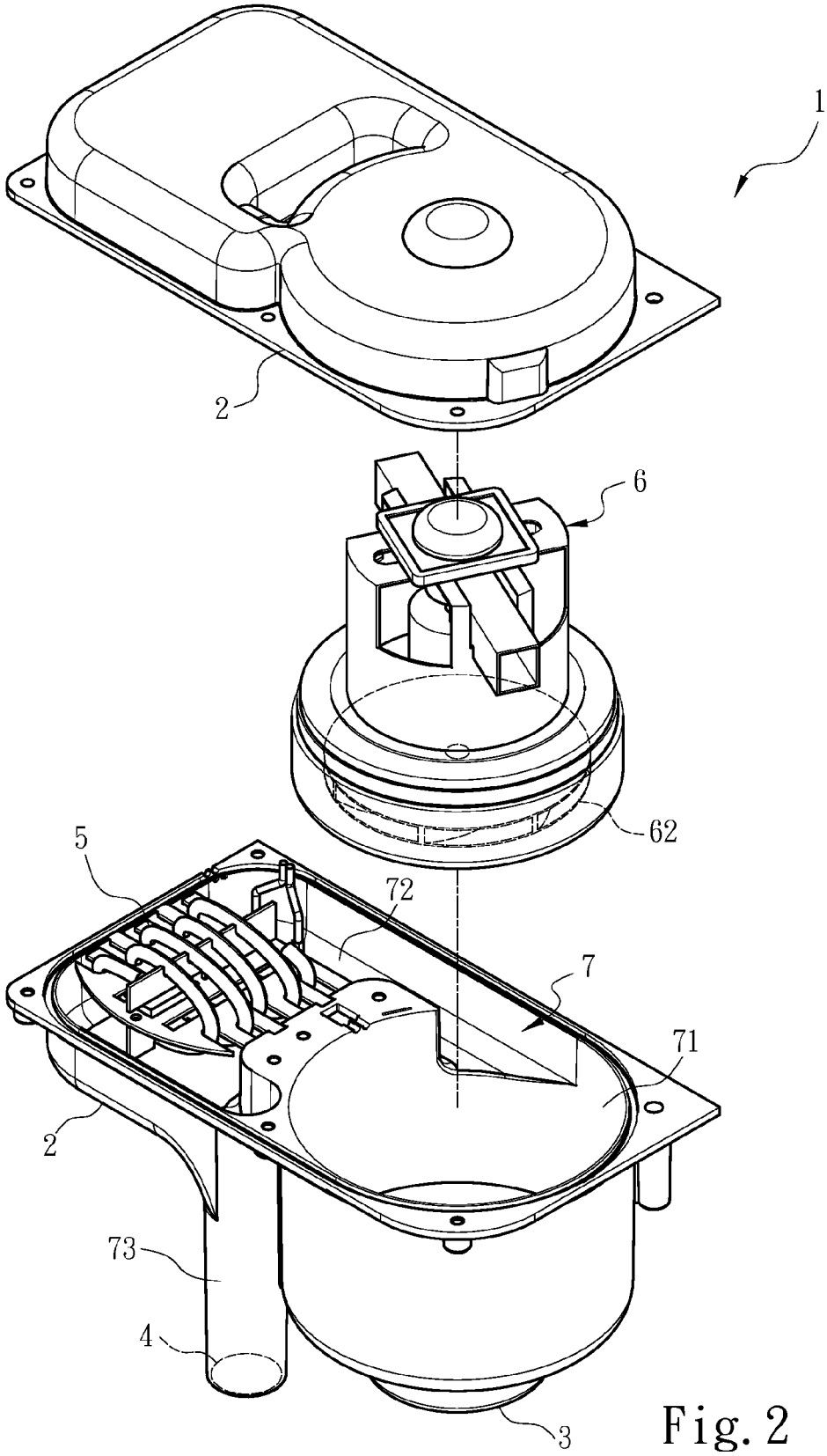
FIG. 2 is a top exploded view of the airflow directing structure of the invention.
Figure 3:
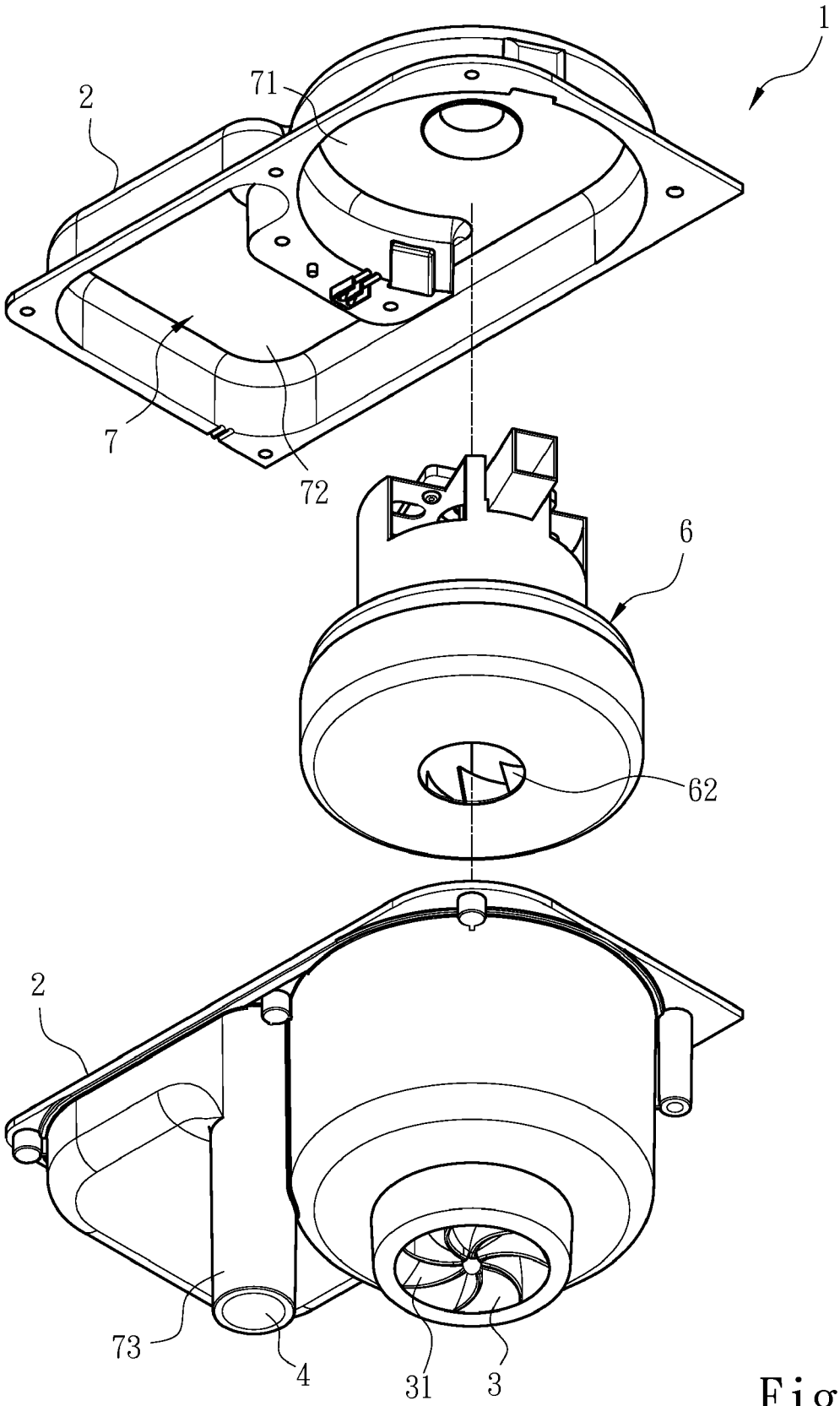
FIG. 3 is a bottom exploded view of the airflow directing structure of the invention.
Figure 4:
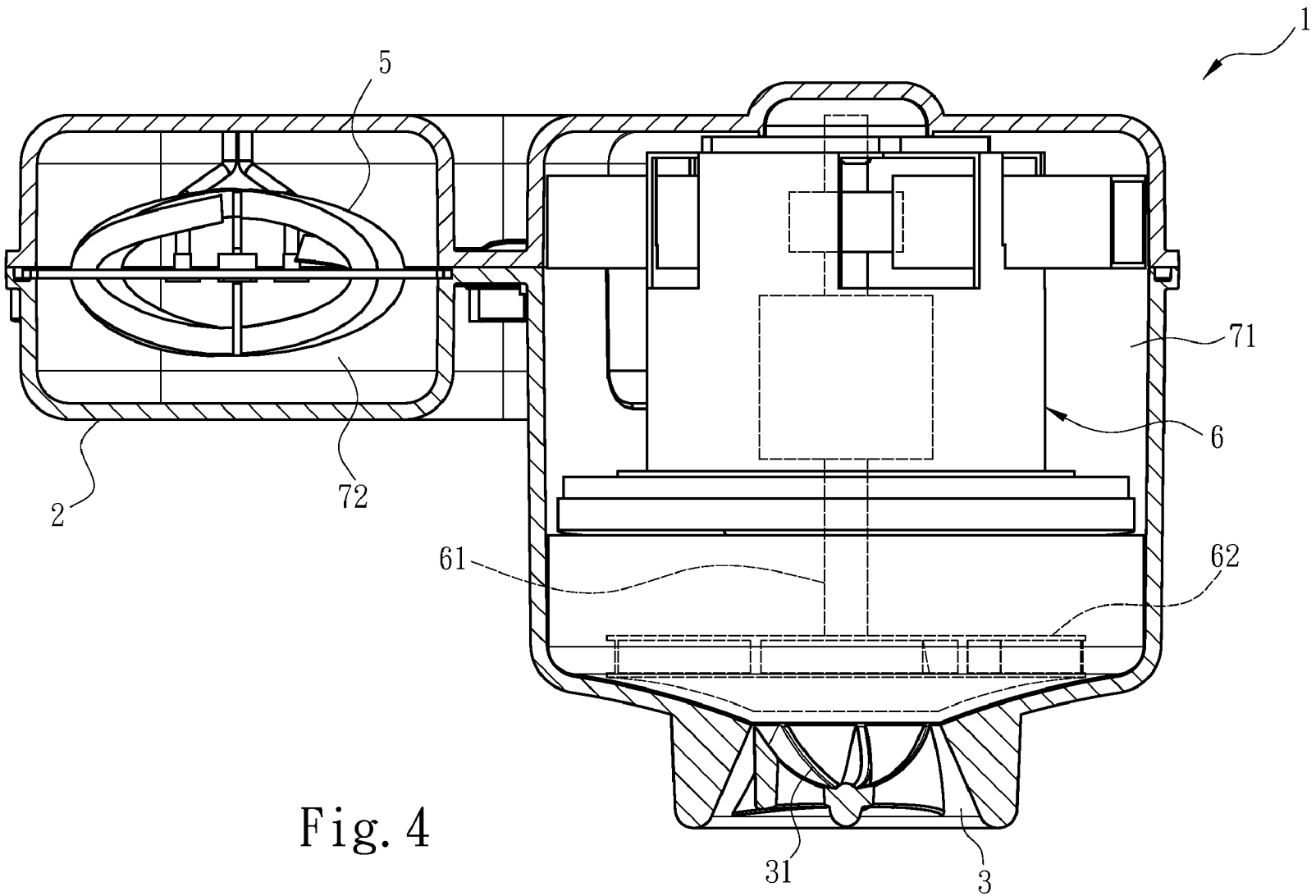
FIG. 4 is a sectional view of the airflow directing structure of the invention.

Please refer to FIGS. 1 through 4 for an embodiment of the airflow directing structure 1 for hand dryers of the invention. It includes an airflow directing case 2, an air inlet 3, an air outlet 4, a heating means 5 and an air intake means 6. The airflow directing case 2 has a flow directing channel 7 inside. The heating means 5 and the air intake means 6 are respectively located in the flow directing channel 7. The air inlet 3 and the air outlet 4 are located at two ends of the flow directing channel 7 and communicate therewith. When the air intake means 6 operates, external air flows through the air inlet 3 into the flow directing channel 7 and passes through the heating means 5 and flows out through the air outlet 4.

In the embodiment shown in the drawings, the flow directing channel 7 further has an air intake passage 71 to hold the air intake means 6 and communicate with the air inlet 3, a tortuous passage 72 to hold the heating means 5 and communicate with the air intake passage 71, and an air exit passage 73 with one end communicating with the tortuous passage 72 and the other end communicating with the air outlet 4. When the air intake means 6 operates and the external air enters the flow directing channel 7, the airflow passes through, in this order, the air intake passage 71, tortuous passage 72 and air exit passage 73. Moreover, the air intake means 6 is located in the air intake passage 71 at one side where the air inlet 3 is formed, and has a rotary axle 61 with one end close to the air inlet 3 formed air intake blades 62. In practice, the air intake passage 71 and the air exit passage 73 are hollow and preferably formed in a cylindrical shape. The rotary axle 61 and the air exit passage 73 are preferably in parallel with each other in a juxtaposed manner. In this embodiment, the air intake blades 62 located at a lower end of the rotary axle 61 close to the air inlet 3 on the same side with the air outlet 4.

In this embodiment, the tortuous passage 72 is substantially formed in a U-shape with one end communicating with the air intake passage 71 and the other end communicating with the air exit passage 73. Moreover, as the air exit passage 73 is parallel with the rotary axle 61 in a juxtaposed manner, and the air intake blades 62 are located in the rotary axle 61 on the same side of the air outlet 4 close to the air inlet 3, the air outlet 4 also is close to the air inlet 3. Of course, the air outlet 4 may also be extended to be closer to or further away from the air inlet 3. Namely, the air outlet 4 and the air inlet 3 preferably have openings formed in the same direction. But this is not the limitation. In addition, the distance between the air exit passage 73 and the rotary axle 61 is preferably no greater than the distance between the heating means 5 and the rotary axle 61, namely, the air exit passage 73 is located between the heating means 5 and the air intake means 6, preferably abutting an outer side of the air intake passage 71, but this is also not the limitation. As the air exit passage 73 must have a sufficient length to smoothly channel heated airflow passing through the heating means 5 located in the tortuous passage 72, added the length of the air intake passage 71 which holds the air intake means 6, in the event that the air intake passage 71 is located upright above the air exit passage 73 with an additional height, or the air intake passage 71 located on a horizontal position at one side of the air exit passage 73 with an additional width, the resulting height or width is greater than by having the air intake passage 71 located upright at one side of the air exit passage 73 (namely the technical approach provided by the invention with the air exit passage 73 in parallel with the rotary axle 61 in a juxtaposed manner). This is mainly because the combined length of the rotary axle 61 and the air inlet 3 is greater than the width of the air intake means 6. Thus the invention can reduce the total size of the final assembly of the airflow directing structure of the hand dryer with a smaller dimension. This results in less material usage and lower material cost. In addition, with the air outlet 4 directing downwards, it better fits user's position in use and can be readily used without extra airflow directing elements (not shown in the drawings). The invention also provides a plurality of flow directing vanes 31 formed with arched profiles the same as that of the air intake blades 62 but in opposite curved directions so that noise generated by airflow shearing can be reduced and airflow intake volume increases.

Figure 5:
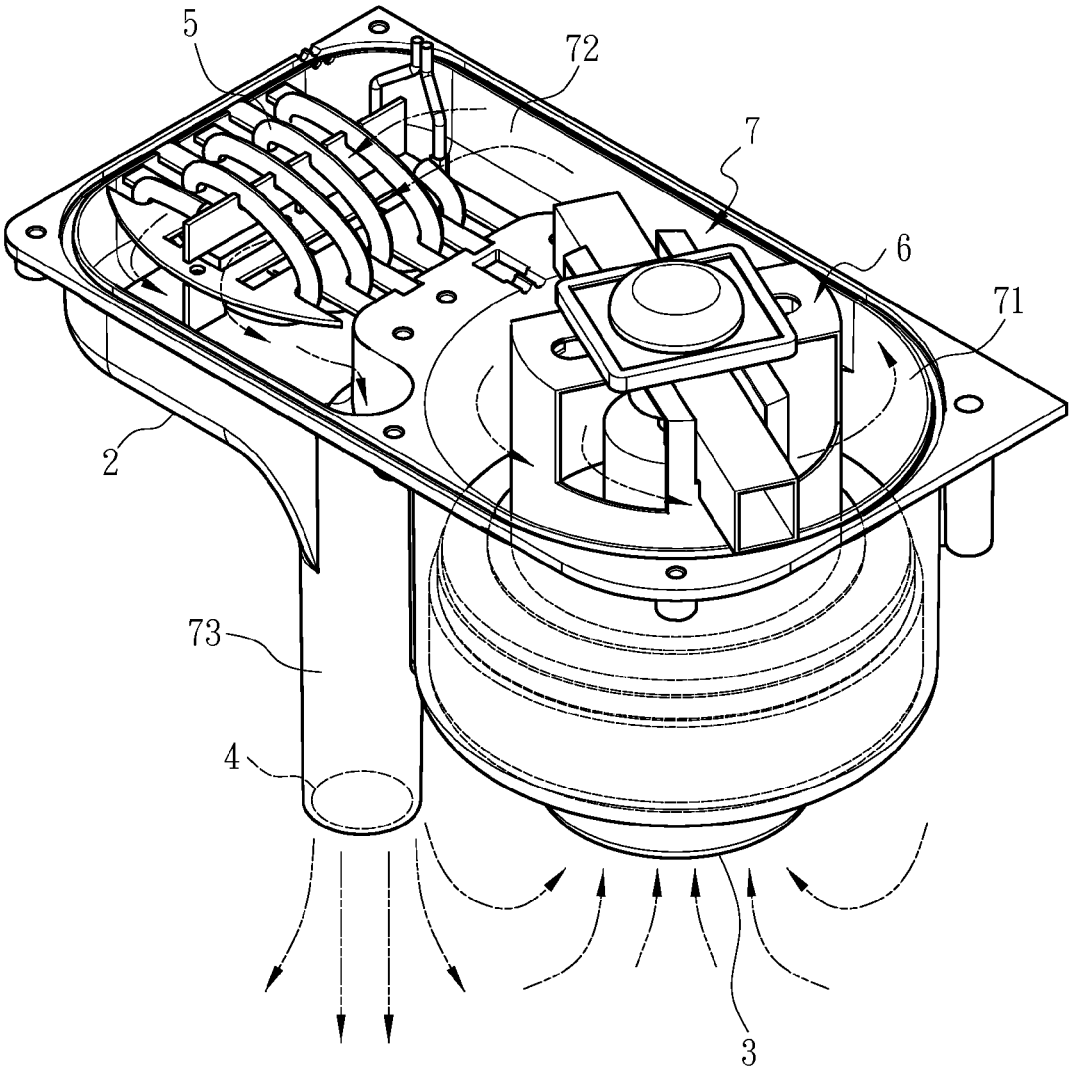
FIG. 5 is a schematic view of airflow simulation of the airflow directing structure of the invention.
Figure 6:
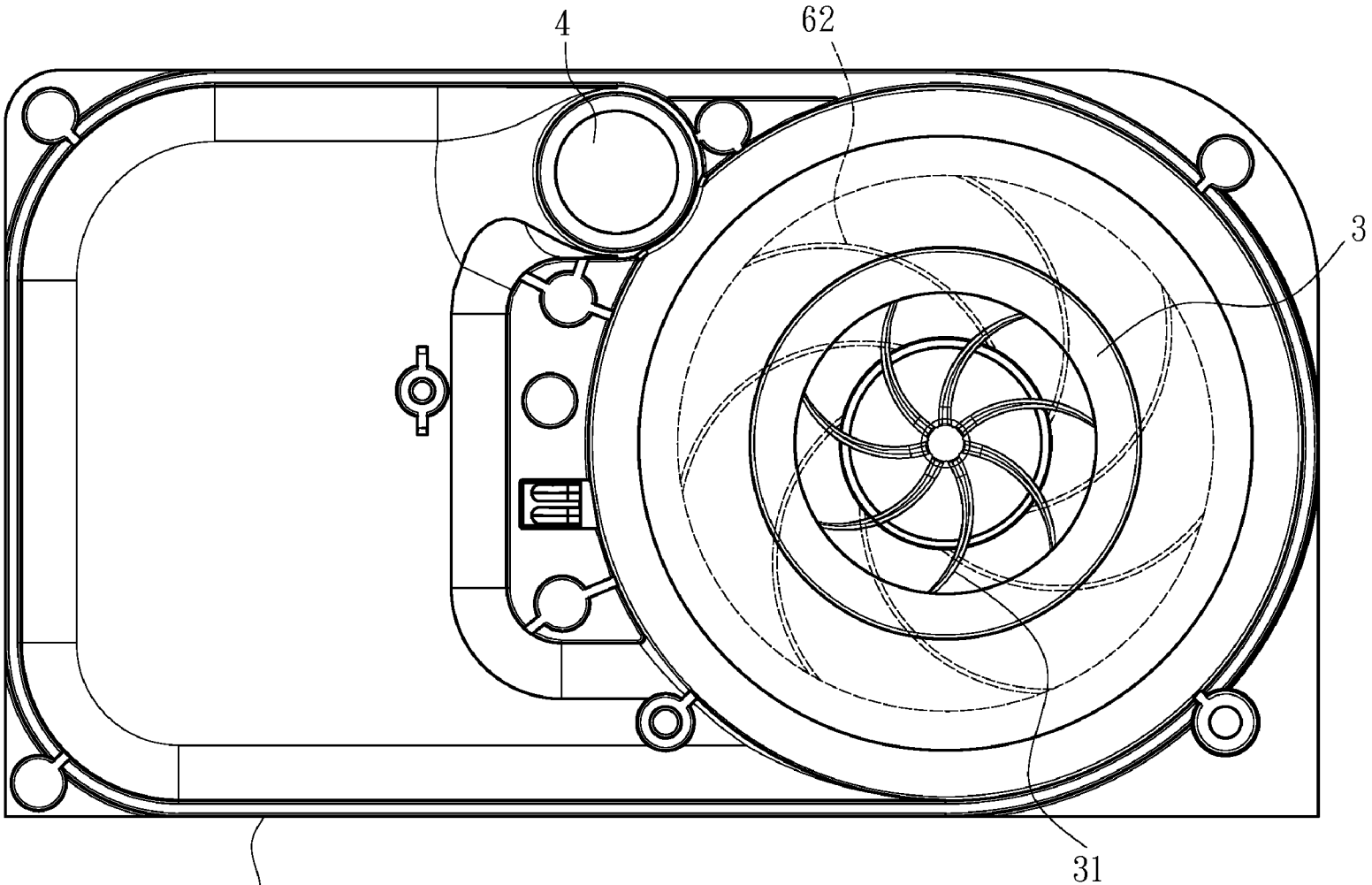
FIG. 6 is a bottom schematic view of the airflow directing structure of the invention.

Refer to FIG. 5 for the simulation of airflow passing through the flow directing channel 7. When air intake starts through the air intake means 6, the external airflow is sucked in by the air intake means 6 through the air inlet 3; driven by the air intake blades 62 (referring to FIGS. 4 and 6), the airflow spirals upwards in the air intake passage 71 and flows into the tortuous passage 72 which has round advance angles and passes through the carved heating means 5 to be heated, then flows under the channeling of the round advance angles to the straight air exit passage 73 to be channeled and converged, finally is discharged through the air outlet 4. In order to reduce resistance of airflow in the flow directing channel 7 and generate smooth and steady flow, the junction of the tortuous passage 72 and the air intake passage 71 is formed in the round advance angles. The tortuous passage 72 is a U-shaped structure to allow the airflow to generate thorough heat exchange with the heating means 5 to prevent uneven heat dissipation. Also referring to FIG. 6, in this embodiment, the air intake means 6 is a high airflow pressure motor. Through the curved direction of the flow directing vanes 31 opposite to that of the air intake blades 62, the outward swirling airflow direction created by the air intake blades 62 can be changed and harnessed so that airflow in the air inlet 3 can be converged to reduce the noise of airflow shearing when the high airflow pressure motor is operating, and air intake volume also increases. Moreover, the cross section of the air exit passage 73 may be smaller than that of the air inlet 3 to get even more airflow exit volume. As a result, through the invention airflow can be heated at an optimal speed to enhance drying effect.

As a conclusion, compared with the conventional techniques, the invention provides at least the following benefits:

1. The air intake passage 71 and air exit passage 73 are hollow and cylindrical, and the tortuous passage 72 is formed with the round advance angles, hence airflow can pass through smoothly and steadily to reduce turbulence, and airflow resistance coefficient is lower and the noise caused by airflow shearing also decreases.

2. The invention provides the flow directing vanes 31 in the air inlet 3 that also can reduce the noise generated by airflow shearing and increase air intake volume.

3. With the air exit passage 73 in parallel with the rotary axle 61, the airflow directing case 2 can be formed at a smaller height to reduce the total size of the airflow directing structure 1 of the hand dryer, thus material cost is lower.

4. With the air exit passage 73 in parallel with the rotary axle 61 in a juxtaposed manner and located at one side of the air intake passage 71 in an abutting manner, air intake and exit directions are opposite, hence a portion of heated airflow discharged from the air outlet 4 can be recycled through the air inlet 3 to get optimal heating speed. And energy consumption also can be reduced.

While the preferred embodiment of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An airflow directing structure for hand dryers, comprising:

an airflow directing case having a flow directing channel;

an air inlet and an air outlet located in the airflow directing case and communicating with the flow directing channel;

a heating means located in the airflow directing case; and an air intake means which is located in the airflow directing case and has a rotary axle which has one end fastened to air intake blades;

wherein the flow directing channel includes an air intake passage to hold the air intake means and communicate with the air inlet, a tortuous passage to hold the heating means and communicate with the air intake passage and an air exit passage which has one end communicating with the tortuous passage and the other end communicating with the air outlet; the air exit passage and the rotary axle being parallel with each other in a juxtaposed manner and located on a same side with the air intake blades and the air outlet.

2. The airflow directing structure of claim 1, wherein the tortuous passage has bend portions formed at round advance angles.

3. The airflow directing structure of claim 1, wherein the air inlet has a plurality of flow directing vanes formed in arched profiles the same as that of the air intake blades and in first curved directions opposite to second curved directions of the air intake blades.

4. The airflow directing structure of claim 1, wherein the air intake means is a high airflow pressure motor.

5. The airflow directing structure of claim 4, wherein the tortuous passage has bend portions formed in round advance angles.

6. The airflow directing structure of claim 4, wherein the air inlet has a plurality of flow directing vanes formed in arched profiles the same as that of the air intake blades and in first curved directions opposite to second curved directions of the air intake blades.

7. The airflow directing structure of claim 4, wherein the air exit passage is located between the heating means and the air intake means.

8. The airflow directing structure of claim 7, wherein the tortuous passage has bend portions formed in round advance angles.

9. The airflow directing structure of claim 8, wherein the air inlet has a plurality of flow directing vanes formed in arched profiles the same as that of the air intake blades and in first curved directions opposite to second curved directions of the air intake blades.

10. The airflow directing structure of claim 7, wherein the air inlet has a plurality of flow directing vanes formed in arched profiles the same as that of the air intake blades and in first curved directions opposite to second curved directions of the air intake blades.

11. The airflow directing structure of claim 1, wherein the air exit passage is located between the heating means and the air intake means.

12. The airflow directing structure of claim 11, wherein the tortuous passage has bend portions formed in round advance angles.

13. The airflow directing structure of claim 11, wherein the air inlet has a plurality of flow directing vanes formed in arched profiles the same as that of the air intake blades and in first curved directions opposite to second curved directions of the air intake blades.

14. The airflow directing structure of claim 12, wherein the air inlet has a plurality of flow directing vanes formed in arched profiles the same as that of the air intake blades and in first curved directions opposite to second curved directions of the air intake blades.

* * * * *